United States Patent [19]

Tackett

[11] Patent Number: 5,011,203

[45] Date of Patent: Apr. 30, 1991

[54] SECURITY DOOR BLOCK

[76] Inventor: Donald L. W. Tackett, R.R. 4, Box 317, Salem, Ill. 62881

[21] Appl. No.: 592,961

[22] Filed: Oct. 4, 1990

[51] Int. Cl.[5] ..... E05C 17/54

[52] U.S. Cl. ..... 292/343; 292/DIG. 60

[58] Field of Search ..... 292/259, 342, 343, 264, 292/DIG. 60

[56] References Cited

U.S. PATENT DOCUMENTS

| | | | |
|---|---|---|---|
| 177,102 | 5/1876 | Daniels | 292/343 |
| 372,655 | 11/1887 | Cashin | 292/343 |
| 377,927 | 2/1888 | Campbell | 292/343 |
| 423,343 | 3/1890 | Renshaw | 292/343 |
| 482,227 | 9/1892 | Conner | 292/264 |
| 656,116 | 8/1900 | Hoffman | 292/343 |
| 718,673 | 1/1903 | Swanburg | 292/343 |
| 776,378 | 11/1904 | Bellamy | 292/343 |
| 804,585 | 11/1905 | Depue | 292/343 |
| 983,618 | 2/1911 | Hammarlund | 292/342 |
| 1,354,046 | 9/1920 | Lanning | 292/343 |
| 1,676,284 | 7/1928 | Powell | 292/343 |
| 2,459,070 | 1/1949 | Gard | 292/343 |
| 3,328,065 | 6/1967 | Arenson | 292/343 |
| 3,664,466 | 5/1972 | Rotheiser | 188/32 |
| 3,706,112 | 12/1972 | Newell | 292/343 |
| 4,019,765 | 4/1977 | Nichola | 292/338 |
| 4,142,752 | 3/1979 | Chilton | 292/343 |
| 4,230,353 | 10/1980 | Bjorgum | 292/343 |
| 4,889,372 | 12/1989 | Dege et al. | 292/218 |

FOREIGN PATENT DOCUMENTS

| | | | |
|---|---|---|---|
| 1036482 | 8/1958 | Fed. Rep. of Germany | 292/343 |
| 278392 | 10/1930 | Italy | 292/343 |
| 141907 | 4/1920 | United Kingdom | 292/343 |

*Primary Examiner*—Richard E. Moore

*Attorney, Agent, or Firm*—Grace J. Fishel

[57] ABSTRACT

A wedge shaped security door block having a door engaging side raked at a low angle with respect to a planar floor engaging side. A device is provided at the apex end of the wedge for manually and selectively truncating the wedge so that it can be used with doors of different thicknesses and doors hung at different spacings between the lower edge of the door and the floor. When the floor is uncarpeted, the door engaging side is preferably inclined at an angle between about 5 and 7 degrees with respect to the floor engaging side and when the floor is carpeted, the angle is preferably between about 7 and 10 degrees to prevent the lower edge of the door from passing over the wedge too far, or passing over it entirely.

12 Claims, 2 Drawing Sheets

14
24
46
44
52
22
10
30
38
20
26
32

12
22
10
14
24
16
26
$F_1$
F
$F_2$
d
32
38
20
18

SECURITY DOOR BLOCK

This invention relates to a security door block to prevent unwanted entry by an intruder.

BACKGROUND OF THE INVENTION

It is known in the prior art to use wedge devices to prevent doors from opening or closing. Most such wedges are designed to hold a door open and are raked at an angle above 10 degrees. As such, they are designed to hold the weight of the door, but not to withstand a force applied by an intruder.

There have been various wedge devices patented to burglar-proof a door but most of them are also raked at an angle above 10 degrees. Resistance to unwanted entry is developed by means of teeth (serrations, spikes, nails and the like which dig into the floor under the force applied by an intruder. The previous burglar-proof wedge devices also tend to mar the floor when the device is installed by a user.

In view of the above, there is a need for a security door block which does not mar the floor but which provides sufficient resistance to withstand the force applied by an intruder. It is therefore an important object of the present invention to provide a security door block which does not mar the floor but which is effective at burglar-proofing a door. Other objects and features of the invention will be in part apparent and in part pointed out hereinafter. The invention accordingly comprises the constructions hereinafter described and their equivalents, the scope of the invention being indicated in the subjoined claims.

SUMMARY OF THE INVENTION

A security door block formed as a wedge shaped body member is adapted to be inserted between the lower edge of a closed door and a floor. The wedge shaped body has a floor engaging side and a door engaging side converging from a rear end of the wedge shaped body towards an apex end. The door engaging side is inclined to the planar floor engaging side at a low angle between about 4 degrees and 10 degrees to maximize the mechanical advantage of the wedging action between the lower edge of the door and the wedge shaped body. The floor engaging side has a floor engaging surface composed of a material the frictional resistance of which with the floor is appreciably greater than the frictional resistance of the lower edge of the door with the door engaging side of the wedge shaped body.

In some embodiments the apex end of the wedge shaped body includes means for manually and selectively truncating the apex end so that the wedge shaped body can be trimmed for use with doors of different thicknesses and with doors hung at different spacings between the lower edge of the door and the floor such that the apex end does not extend beyond the outside lower edge of the door where it could be kicked loose. In other embodiments particularly useful with uncarpeted floors, the angle of inclination between the door engaging side and the floor engaging side is preferably between about 5 and 7 degrees, whereas with carpeted floors, the angle is preferably between about 7 and 10 degrees.

Other embodiments are adapted for use with doors having a raised threshold or for use with additional means for securing the wedge shaped body fast in operative position.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
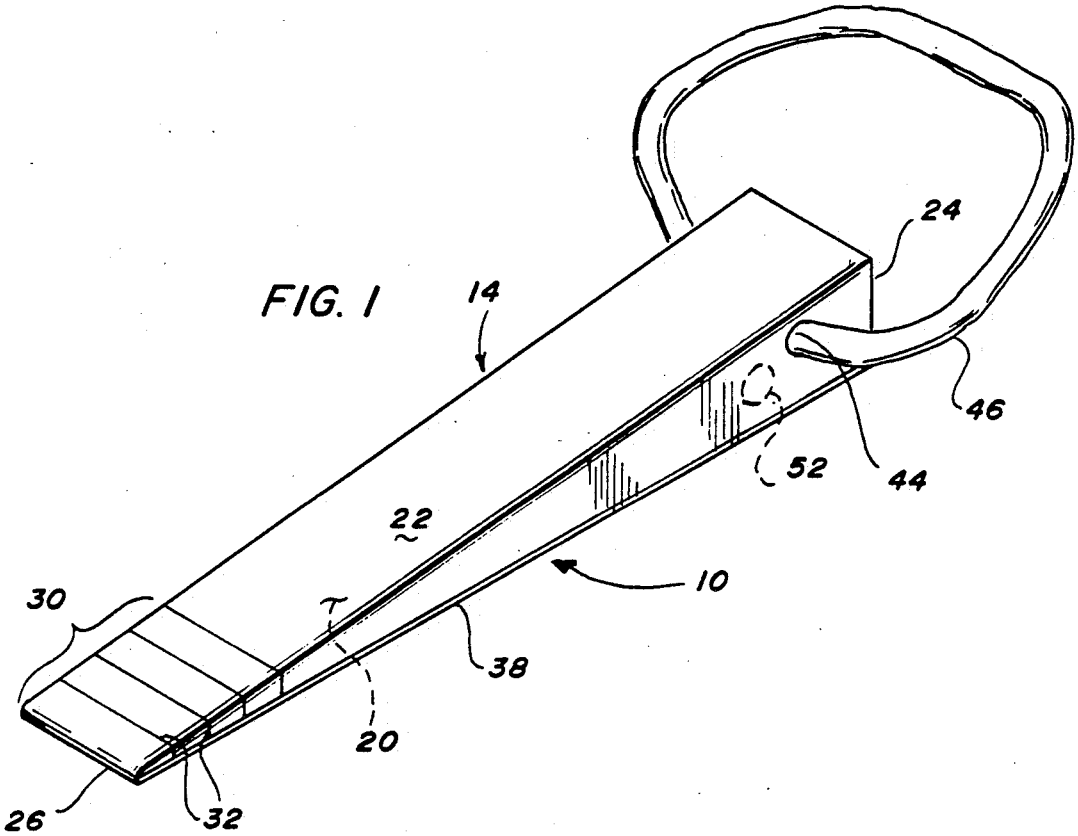
FIG. 1 is a perspective view of a security door block in accordance the present invention.
Figure 2:
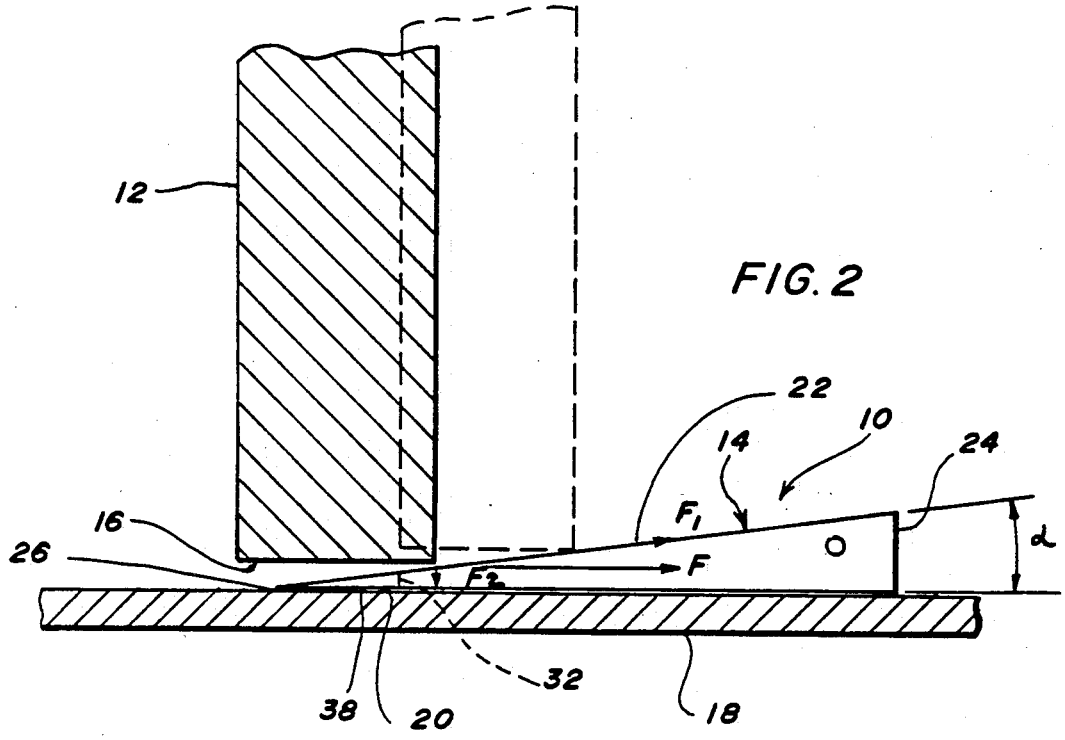
FIG. 2 is a sectional view taken along line 2—2 in FIG. 1 showing the security door block in use on an uncarpeted floor under a door with a second door shown in dotted lines.

Referring to the drawings, a security door block of the present invention is designated generally by reference numeral 10 in FIG. 1 and is shown in operative relationship with a door 12 in FIG. 2. Security door block 10 comprises a wedge shaped body 14 adapted to be inserted between a lower edge 16 of closed door 12 and an uncarpeted floor 18. Wedge shaped body 14 has a floor engaging planar side 20 and a door engaging angular side 22 converging with planar side 20 from a rear end 24 towards an apex end 26.

Door engaging side 22 is inclined at a low angle with respect to floor engaging side 20 to maximize the mechanical advantage of the wedging action between lower edge 16 of door 12 and wedge shaped body 14. More particularly as shown in FIG. 2, when a force F is applied on door 12 by an intruder, the force translates on security door block 10 into a large component of force $F_1$ causing lower edge 16 of door 12 to slide along door engaging side 22 and a small component of force $F_2$ tending to push the block down onto floor 18 and away from door 12. By inclining door engaging side 22 to floor engaging side 20 at an angle between about 4 degrees and 10 degrees (shown as Greek letter ALPHA in the drawings), the wedging action is maximized. Angles lower than about 4 degrees are not practical because door 12 opens too far before it is stopped or because it slides over wedge shaped body 14 entirely.

Figure 4:
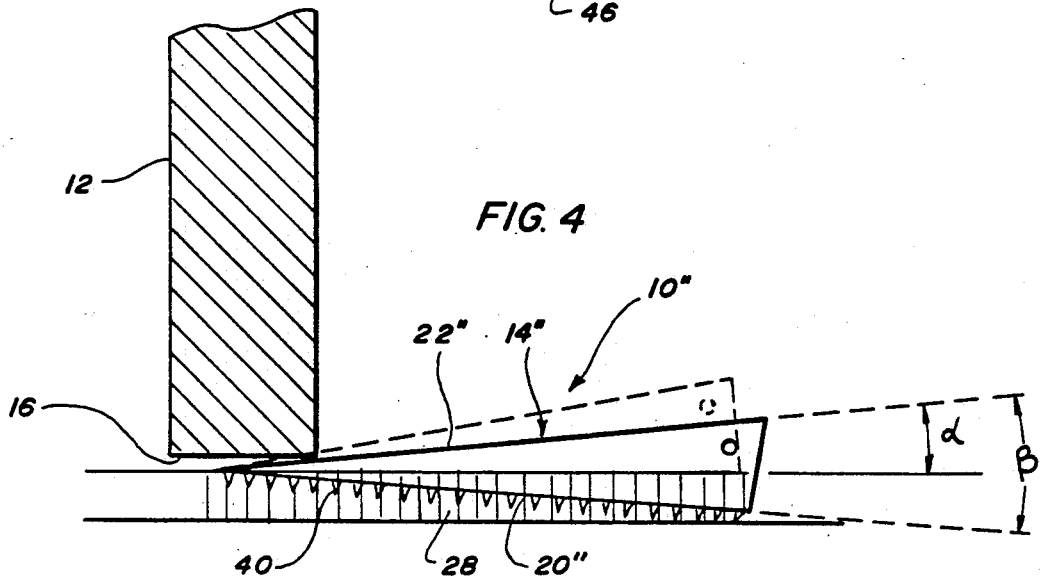
FIG. 4 is a sectional view like FIG. 2 showing a security door block in use on a carpeted floor; and, FIG. 5 is a perspective view of the security door block shown in FIGS. 1 and 2 in use with a band attached to a base plate or wall studs at opposite sides of a door frame and casing and secured to the rear end of the security door block.

On uncarpeted floor 18 as illustrated in FIG. 2, the angle between door engaging side 22 and floor engaging side 20 is preferably between about 5 and 7 degrees. However, on carpeted floor 28 as shown in FIG. 4, the angle is preferably between about 7 and 10 degrees (shown as Greek letter BETA in the drawings). A higher angle is needed with carpeted floor 28 because force F applied by an intruder tends to push rear end 24 of wedge shaped body 14 down into the carpet. This causes the effective angle between door engaging side 22 with respect to planar (i.e., the floor under the carpet) to decrease. By starting with a higher angle BETA, the angle ALPHA necessary to keep lower edge 16 of door 12 from passing over wedge shaped body 14 too far, or passing over entirely, is maintained when force F is applied.

As best seen in FIG. 1, apex end 26 of wedge shaped body 14 preferably includes a means 30 for manually and selectively truncating the leading end. As shown, means 30 can be formed as a plurality of parallel scores 32 spaced rearwardly from apex end 26. The depth of scores 32 is selected such that the tip of apex end 26 can be snapped off at the selected score line 32 by the user with his fingers or with a pair of pliers, case knife or the like. Scores 32 are preferably no deeper than necessary so that the tip of apex end 26 is not unduly weakened.

As illustrated in FIG. 2, means 30 for manually and selectively truncating the apex of wedge shaped body 14 permit the user to trim the wedge shaped body for use with doors of different thicknesses (such as door 34 shown in dotted lines) and doors hung at different spacings between the lower edge of the door and the floor (such as lower edge 36 of door 34) so that apex end 26 does not extend beyond the outside lower edge of door 34 where it could be kicked.

Wedge shaped body 14 can be made from a resistant material such as wood, plastic or the like and, as such, can be manufactured simply and economically and these savings can then be passed on to the consumer. Floor engaging side 20 has floor engaging surface 38 composed of a material the frictional resistance of which with the floor is greater than the frictional resistance of lower edge 16 of door 12 with door engaging side 22. For best results, door engaging side 22 is provided with a smooth or even highly polished surface so as to offer as little resistance as possible to movement of lower edge 16 along door engaging side 22.

With uncarpeted floor 18, floor engaging surface 38 is preferably covered with a rubber-like material. Other roughed surfaces which do not mar floor 18 can also be used. Included in this class is sandpaper or the like if a complementary piece of sandpaper (not shown) is attached to floor 18. On the other hand, with carpeted floor 28, floor engaging surface 38 is preferably provided with a plurality of spaced rigid depending projections or spikes 40 for digging into the face of the rug. When wedge shaped body 14 is formed of plastic, spikes 40 may be integrally molded with the rest of the body.

Figure 3:
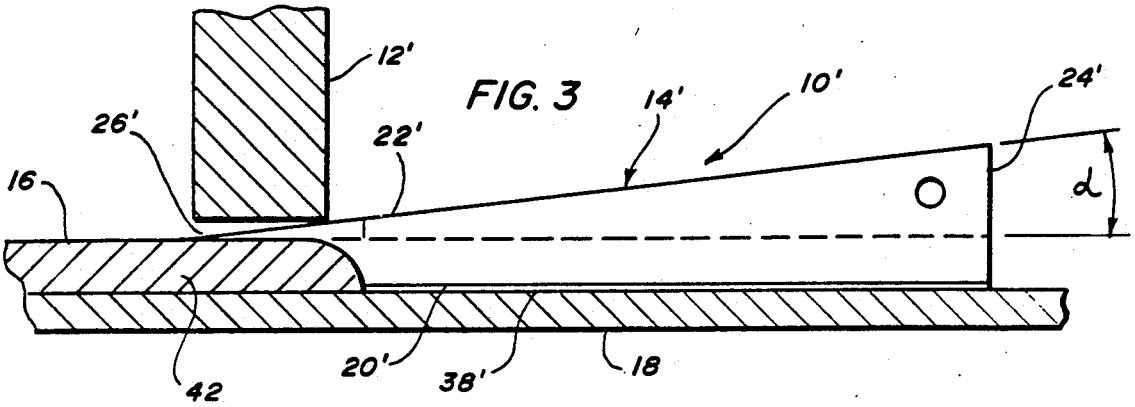
FIG. 3 is a sectional view like FIG. 2 showing a security door block which is adapted to conform to a raised threshold in use on an uncarpeted floor.

When door 12 meets with a threshold 42 as shown in FIG. 3, apex end 26 preferably is adapted to conform to the threshold. The slope of door engaging side 22 is unchanged in this construction and floor engaging side 20 is outfitted with floor engaging surface 38 suitable to the nature of the floor (i.e., carpeted or uncarpeted).

A hole 44 is provided in rear end 24 through which a loop 46 is passed serving as a handle for pulling security door block 10 free from under the door, picking it up when it is not in use and hanging it on a door knob (not shown) or the like. Handle or loop 46 can be used to easily and quickly remove security door block 10 from under the door in case of an emergency. Other handles as will occur to one skilled in the art are also, more or less, suitable for the same purpose(s).

Figure 5:
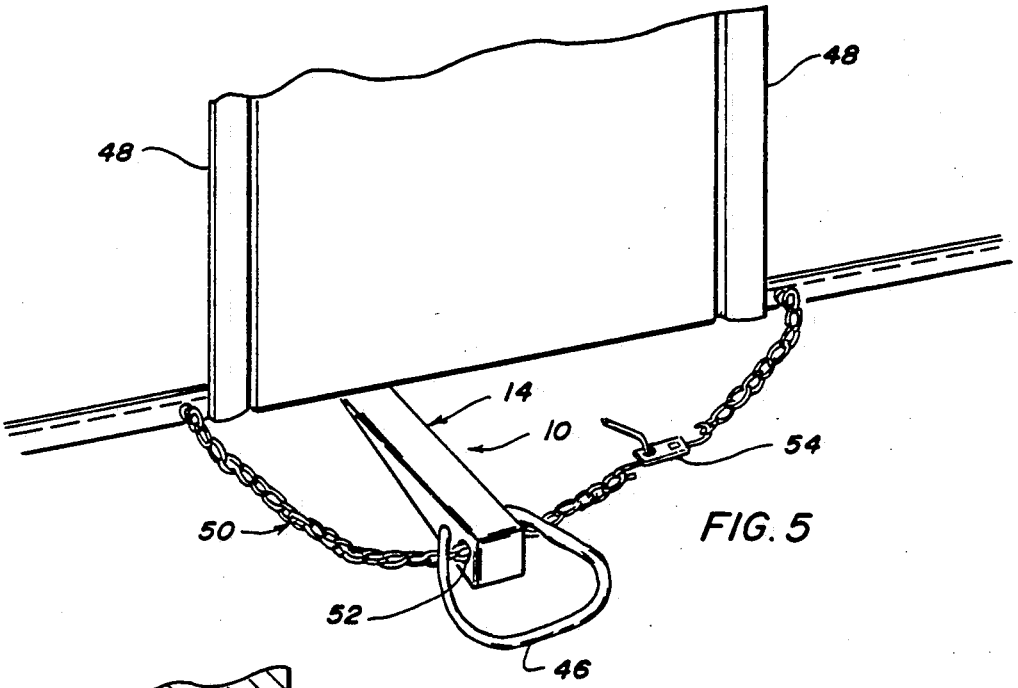

As illustrated in FIG. 5, security door block 10 can be made additionally secure with a band 48 (formed of chain, cable or the like) firmly attached to walls 50 adjacent the lower edge of the door. Walls 50 are typically formed from a framework of studs (not shown) attached to a base plate (not shown) and covered with wallboard or paneling. The base of walls 50 is typically finished with a base trim 52 and the door opening is usually completed with a door frame and casing (frequently sold as an assembly and set into the door opening as a unit) generally indicated at 54. Band 48 is preferably attached into the studs or the base plate so that it cannot be easily pulled loose. Band 48 is secured to rear end 24 of wedge shaped body 14, most conveniently by passing through a hole 56 provided therefor. A means 58 for taking-up slack is provided in band 48 for tightening the band.

Many, and perhaps most, group apartments built today (which are usually occupied by young or old persons who are most likely to be preyed upon by criminals) and college dormitory rooms have front doors with no threshold and locks which can be opened with a master key or broken out of the door frame. The present invention is intended to provide an auxiliary lock which can be applied by the occupant without tools to make it very difficult or impossible to open the door from the outside by force. Security door block 10 is intended to make the occupant feel more secure and to make his or her family feel more secure knowing that it is being used.

The present invention is useful with doors having thresholds and doors with locks which cannot be opened with a master key or easily broken out. It is also useful in free standing houses, motel rooms and wherever the need for additional security is felt.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A security door block comprising a wedge shaped body member adapted to be inserted between the lower edge of a closed door and a floor and having a floor engaging side and a door engaging side converging from a rear end towards an apex end, said door engaging side inclined at a low angle to the floor engaging side between 4 degrees and 10 degrees to maximize the mechanical advantage of the wedging action between the lower edge of the door and the wedge shaped body, said floor engaging side having a floor engaging surface composed of a material the frictional resistance of which with the floor is appreciably greater than the frictional resistance of the lower edge of the door with the door engaging side of the wedge shaped body, said apex end of the wedge shaped body including means for manually and selectively truncating the apex end whereby the wedge shaped body can be trimmed for use with doors of different thicknesses and doors hung at different spacings between the lower edge of the door and the floor such that the apex end does not extend beyond the outside lower edge of the door where it could be kicked.

2. The security door block of claim 1 for use with uncarpeted floors wherein the door engaging side is inclined to the floor engaging side at an angle between 5 and 7 degrees and wherein the floor engaging side is covered with a rubber-like material.

3. The security door block of claim 1 for use with carpeted floors wherein the door engaging side is inclined to the floor engaging side at an angle between 7 and 10 degrees and wherein the floor engaging side is covered with spikes.

4. The security door block of claim 1 wherein the lower edge of the door meets with a threshold and the apex end of the wedge shaped member is adapted to conform to the threshold.

5. The security door block of claim 1 for use with a door framed in a wall wherein a band is attached to the wall at opposite sides of the door adjacent the lower edge thereof and is secured to the rear end of the wedge shaped body for securing the wedge shaped body to the wall.

6. The security door block of claim 5 wherein a means for taking-up slack is provided in the band for tightening the band.

7. The security door block of claims 2, 3, 4, 5, or 6 having a handle on the rear end of the wedge shaped body.

8. A security door block for use with uncarpeted floors comprising a wedge shaped body member adapted to be inserted between the lower edge of a closed door and a floor and having a floor engaging side and a door engaging side converging from a rear end towards an apex end, said door engaging side inclined at a low angle to the floor engaging side between 5 degrees and 7 degrees to maximize the mechanical advantage of the wedging action between the lower edge of the door and the wedge shaped body and said floor engaging side having a floor engaging surface composed of a material the frictional resistance of which with the floor is appreciably greater than the frictional resistance of the lower edge of the door with the door engaging side of the wedge shaped body, said apex end of the wedge shaped body including means for manually and selectively truncating the apex end whereby the wedge shaped body can be trimmed for use with doors of different thickness and doors hung at different spacings between the lower edge of the door and the floor such that the apex end does not extend beyond the outside lower edge of the door where it could be kicked.

9. The security door block of claim 8 wherein the lower edge of the door meets with a threshold and the apex end of the wedge shaped member is adapted to conform to the threshold.

10. The security door block of claim 8 for use with a door framed in a wall wherein a band is attached to the wall at opposite sides of the door adjacent the lower edge thereof and is secured to the rear end of the wedge shaped body for securing the wedge shaped body to the wall.

11. The security door block of claim 10 wherein a means for taking-up slack is provided in the band for tightening the band.

12. The security door of claims 8, 9 or 10 having a handle on the rear end of the wedge shaped body.

* * * * *